United States Patent [19]

Lawson

[11] Patent Number: 4,782,554

[45] Date of Patent: Nov. 8, 1988

[54] CURTAIN ROD COVER

[76] Inventor: Richard W. Lawson, 167 Woodlake, Hilton Head Island, S.C. 29928

[21] Appl. No.: 947,435

[22] Filed: Dec. 29, 1986

[51] Int. Cl.[4] ..... A47H 1/02

[52] U.S. Cl. ..... 16/87.4 R; 16/95 D

[58] Field of Search ..... 16/87.2, 87.4 R, 95 D, 16/95 R; 160/330, 395, 391, 384, 382, 345, 19, 38, 39; 211/105.1, 105.2, 123; 248/261; D25/55; D6/575

[56] References Cited

U.S. PATENT DOCUMENTS

| | | | |
|---|---|---|---|
| Re. 22,989 | 3/1948 | Ganter | 211/105.1 |
| 440,773 | 11/1890 | Lewis | 211/105.1 |
| 684,674 | 10/1901 | Clark | 211/123 |
| 737,585 | 9/1903 | Crossley | 211/123 |
| 776,043 | 11/1904 | Bahme | 160/38 |
| 823,259 | 6/1906 | Burns | 211/105.2 |
| 838,867 | 12/1906 | Lalus | 211/123 |
| 904,229 | 11/1908 | Robinson | 211/105.1 |
| 1,077,529 | 11/1913 | Griffin | 160/330 |
| 1,079,431 | 11/1913 | Nitka | 160/330 |
| 1,727,528 | 9/1929 | Truemper | 160/39 |
| 2,323,112 | 6/1943 | Birnie | 211/105.2 |
| 2,516,490 | 7/1950 | Steinmeyer | 211/105.1 |
| 2,824,606 | 2/1958 | Lorentzen | 160/38 |
| 3,643,288 | 2/1972 | Olivari | 16/95 D |
| 4,167,205 | 9/1979 | Gerdeman | 160/330 |

FOREIGN PATENT DOCUMENTS

| | | | |
|---|---|---|---|
| 935211 | 11/1955 | Fed. Rep. of Germany | 160/330 |

*Primary Examiner*—Fred A. Silverberg
*Attorney, Agent, or Firm*—W. C. Tupman

[57] ABSTRACT

A cover unit for an existing curtain rod including an elongated tubular member for covering the rod and a pair of end pieces for covering the end brackets of the curtain rod. Interior clamps are provided for securing a decorative fabric or wallpaper to the outer surface of the cover. The tubular member may be cut to a desired length and a plurality of tubular members may be connected together to increase the overall length thereof.

15 Claims, 3 Drawing Sheets

CURTAIN ROD COVER

SUMMARY

This invention relates to decorating an existing drapery or curtain rod assembly with a cover which is located over the outer surface of the rod. The lower edge of the cover is intended to be positioned very close to the lower edge of the curtain rod so that the cover creates the appearance that the curtain depends from the cover.

It is well known that different window coverings may be used to decorate a window and many of these involve tubular shaped members which present a curved exposed surface to the viewer. These window units, however, consist of the curtain rod assembly itself rather then an attached to an existing assembly. Valances or cornices for windows are also well known, but, hereagain, the valance or cornice is either separately fixed to the wall or itself carries the hardware used to support the window covering material.

It is therefore an object of this invention to provide a decorative cover for a curtain rod assembly. Another object includes means to secure a decorative fabric or paper about the outer surface of the cover.

Another object includes the use of plastic materials which can easily be cut to a desired length so as to fit a plurality of windows. Also, the overall length of the cover may be increased with the use of suitable connectors.

A still further object is to package all the pieces needed to assemble a cover over an existing curtain rod into a single kit.

DESCRIPTION OF THE PREFERRED EMBODIMENT

Figure 1:
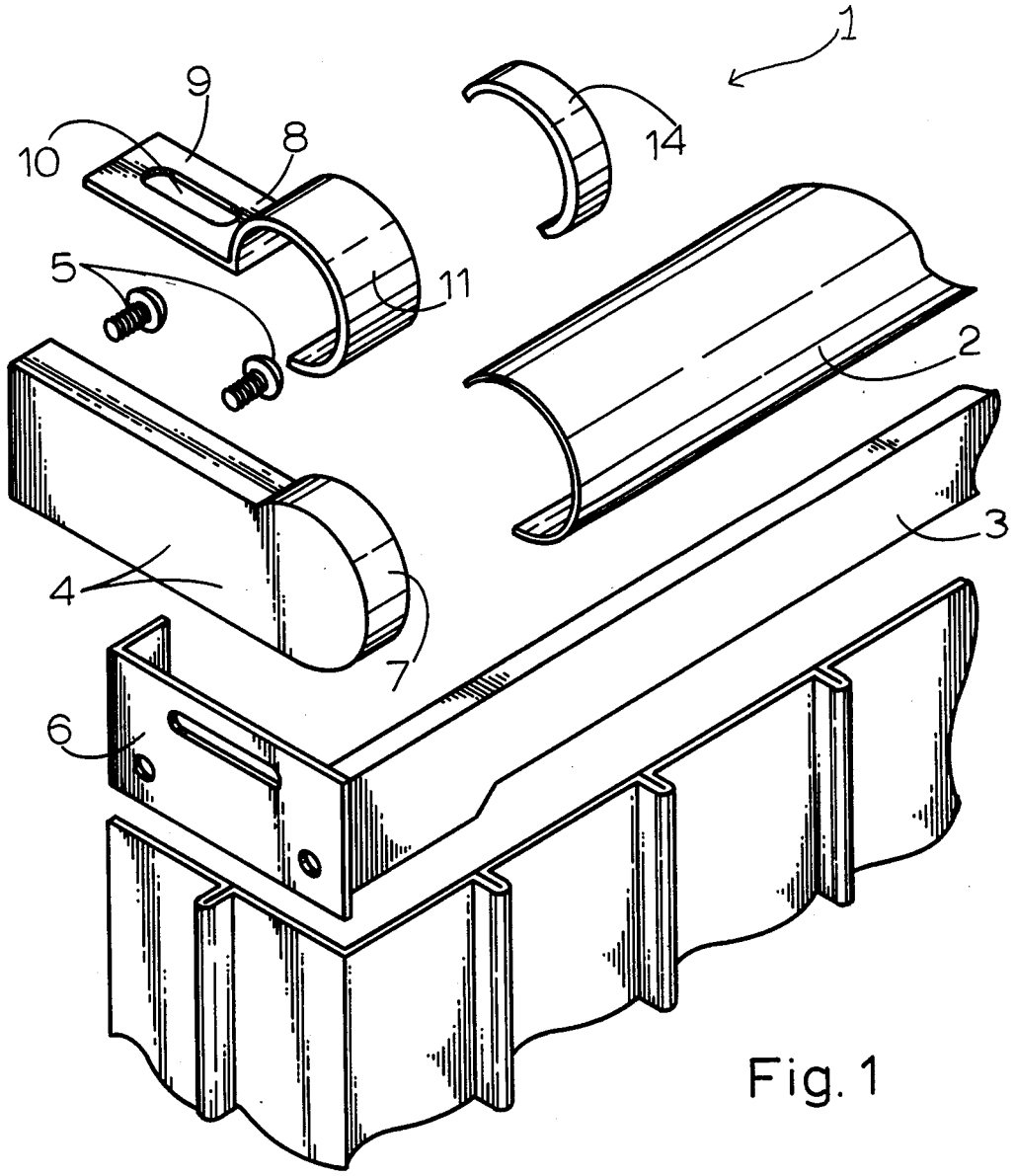
FIG. 1 is an exploded isometric view of my curtain rod cover adapted to be secured to an existing curtain rod.

Referring to the drawing, FIG. 1 shows the several pieces of the cover 1 in an exploded relationship with an existing drapery or curtain rod assembly. The cover 1 is a self contained unit and may be used in redecorating a window unit by being attached to the curtain rod.

The cover 1 comprises an elongated tubular member 2 which has an opened portion located at its lower rear face that extends along the entire length of the tubular member. The tubular member 2 is intended to be positioned over the front face and the top portion of a conventional drapery or curtain rod 3. An end piece 4 is used to secure one end of the tubular member 2 in place. This is accomplished by securely fastening the end piece 4 to the existing wall bracket 6 of the curtain rod assembly by means of screws 5 or a suitable nut and bolt assembly. The end piece 4 is provided with a curved end portion which is shaped to closely correspond to the size of the inner surface of the tubular member 2. With an end piece 4 fastened to a bracket 6 at each end of the curtain rod 3, a tubular member of a length equal to the length of a curtain rod may be positioned over the curved end portion 7 and thereby held in place over the curtain rod. If the existing curtain rod 3 is of an extended length and has a conventional, centrally positioned supporting bracket, a bracket 8 should be used to further support the tubular member 2 intermediate its length. Bracket 8 comprises a flat portion 9 intended to rest upon the central curtain rod bracket and may be secured thereto by means of a suitable nut and bolt assembly extending through the elongated slot 10 therein. A curved end portion 11 is of a size to be snapped into the inside of a tubular member 2 and thus provide added support thereto in the same manner that a central bracket will further support a curtain rod 3.

Figure 3:
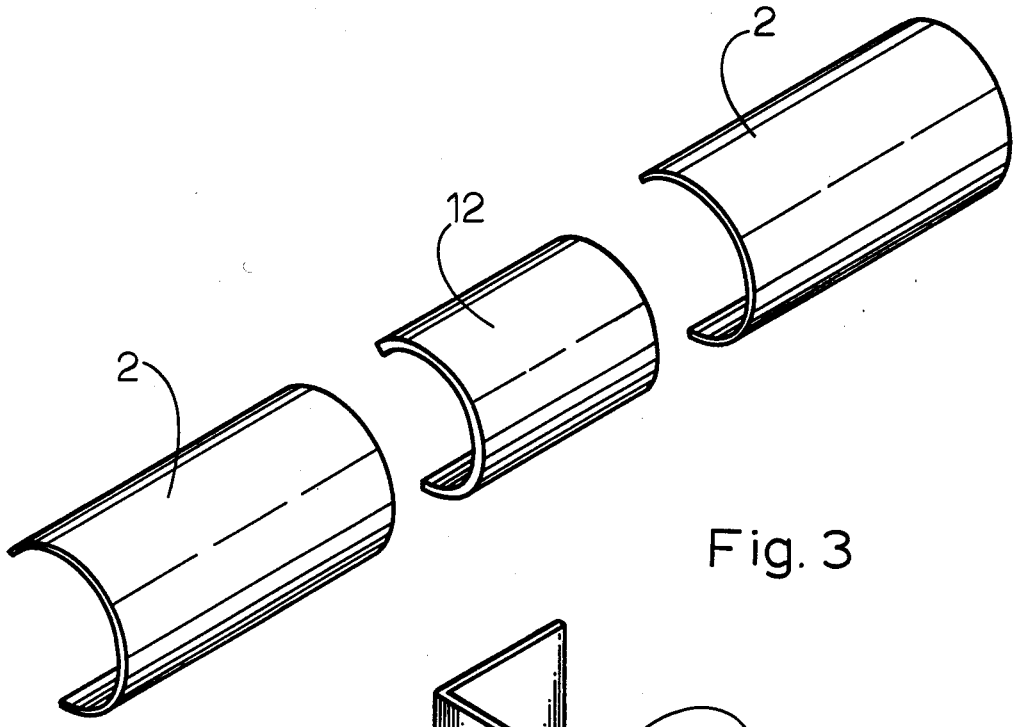
FIG. 3 is an exploded isometric view of a connector used to secure two tubular members together.

As shown in FIG. 3, a plurality of tubular members may be connected together to provide a cover for a relatively long curtain rod. This is accomplished by means of a connector 12 which is shaped to closely fit within a tubular portion. Thus, a connector 12 may be partially positioned within the end of a tubular member 2 so that another tubular member 2 may be positioned on the extending portion of the connector 12. With the two tubular members 2 closely abutted over the connector 12, the length of the cover 1 is effectively increased. By using a plurality of connectors 12 and tubular members 2, a cover of unlimited length may be obtained.

It is desired that the tubular members 2 and the connectors 12 be made of a suitable plastic such as that presently used for plumbing purposes. These members may also be made from metal, wherein special decorator interests can be achieved. However, the use of plastic is less expensive and may itself be provided in a plurality of different decorator colors. While the tubular members 2 may be formed by suitably cutting a conventional plastic tube, they may be made by extruding plastic material through a die so as to achieve the C-shaped cross-section directly from the molding operation. This would eliminate the cutting procedure. However, the overall length of the cover may be easily adjusted to one's individual needs by cross cutting the tubular members to a desired length. The end pieces 4 and the brackets 8 may also be made of plastic. While the end pieces may be made of wood or even metal, the brackets 8 are adapted to be made of a suitable spring steel.

Figure 2:
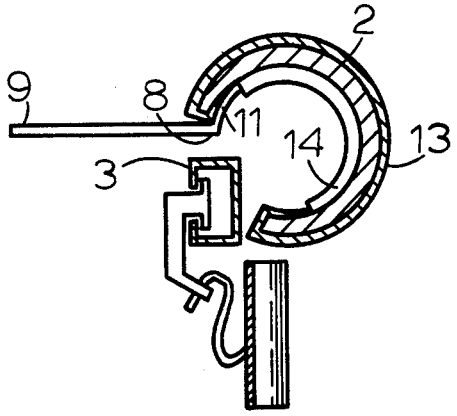
FIG. 2 is a cross-sectional view taken intermediate the ends of a cover which has been assembled on an existing curtain rod.

As best shown in FIG. 2, a fabric 13 may be used to cover the outer surface of the tubular member 2. The same fabric used in making the curtain may also be used as a covering for the tubular member 2. A plurality of plastic or metallic C-clamps 14 may be positioned along the length of the cover to suitably secure the fabric 13 to the tubular member 2. The end pieces 4 may, likewise, be covered with the same fabric used to cover the tubular members. For a wooden end piece 4, the fabric may be tacked on the inner surface thereof. Instead of covering these members with a fabric material, it is possible to use decorator wallpaper as the covering, especially when the pattern on the wallpaper is the same as the pattern on the curtain fabric.

Figure 4:
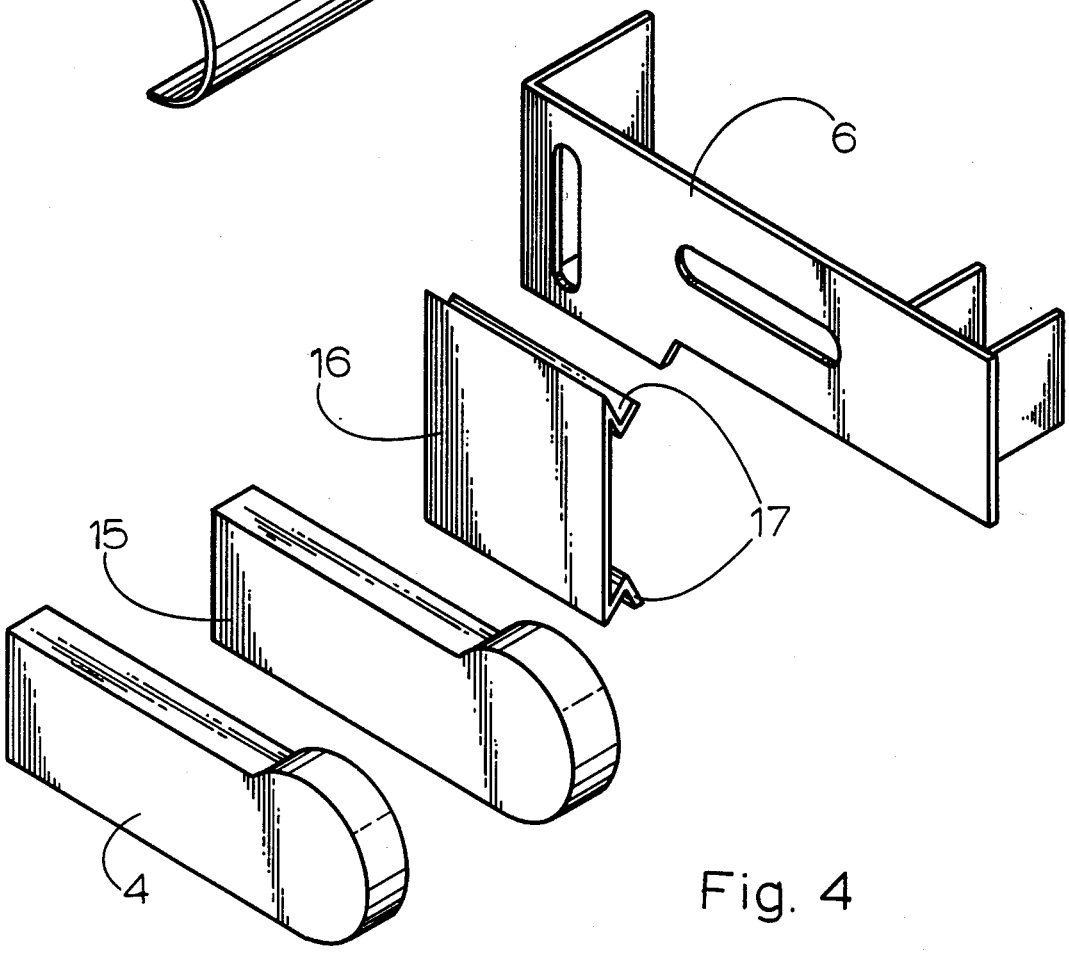
FIG. 4 is an exploded isometric view of a modified end piece assembly.

As shown in FIG. 4, a modified end piece 4 is made of either plastic or metal and is hollow on its inner surface so as to snugly receive a retainer member 15. Thus, fabric or wallpaper may be clamped in place on the outer surface of the end piece 4 by the retainer member 15. Similarly, the retainer 15 and its end piece 4 is clamped to an existing bracket 6 by means of a spring clip 16. This is accomplished by snapping flanges 17 of the clip 16 over the top and bottom edges of the bracket 6 with the body of the clip frictionally secured within the retainer 15. The plastic or metallic end piece 4 of FIG. 4 is similar in size and shape to the wooden end piece 4 of FIG. 1.

Figure 5:
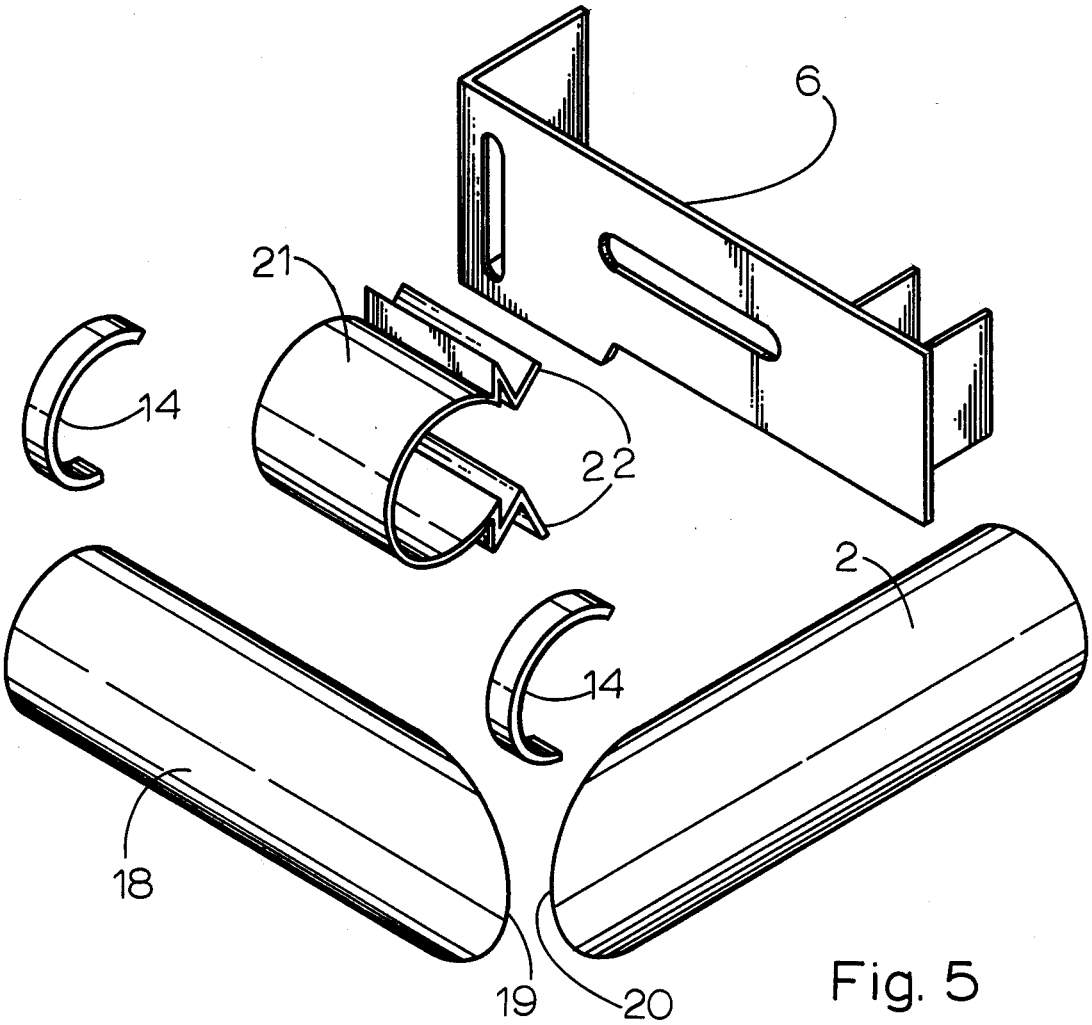
FIG. 5 is an exploded isometric view of a further modified end piece assembly.

Another modified end piece arrangement is shown in FIG. 5. The end piece comprises a piece of plastic tubing 18 of the same material used to make the tubular member 2. One end of the tubing 18 is mitered at 19 and will provide an attractive edge when abutted against a correspondingly mitered edge 20 at the adjacent end of the tubular member 2. C-clamps 14 are used to clamp any fabric or wallpaper positioned about the end piece 18. A spring clip 21 is used to fasten the end piece 18 to an existing bracket 6 and is provided with a curved surface for engagement with the inner surface of the end piece 18 and with flanges 22 for engagement with bracket 6.

Although not shown in the drawing, it is possible to provide a vertical tubular member along each side of the window. A mitered joint, similar to that presented in FIG. 5, would be used to join each vertical member with the horizontal top tubular member 2. Suitable wall brackets would be provided along each vertical member to provide the necessary support therefore. The tubular member 2 would be cut to a length to extend beyond the end brackets 6 and the end pieces 4 a distance sufficient to accommodate the two vertical members. In this instance, the tubular members would frame the window.

Figure 6:
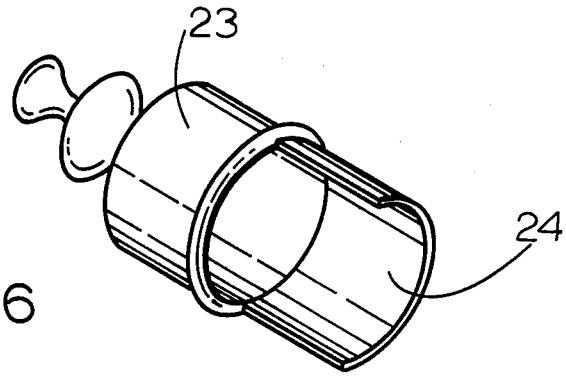
FIG. 6 is an isometric view of a typical terminal attachment for one end of the assembly.

The tubular member 2 may be provided with a specially shaped end unit. An example of such an end unit is shown in FIG. 6 and 23 and is provided with an integral, C-shaped portion 24 which is adapted to extend into the open end of an adjacent tubular member 2. Thus, an end unit may be used to further decorate each end of the cover 1 and may be used either with or without an end piece 4.

The various members needed to cover a single curtain rod may be packaged as a kit (not shown). In this instance, a plurality of different end piece sets may be carried in the kit, so as to give the purchaser a variety of choices within a single packaged unit. Also, the various members could be carried in bulk form at any retail outlet carrying curtain rods or the like. In this instance, the purchaser may choose the individual items needed to complete the covering of a curtain rod.

Since various changes may be made in the construction of this curtain rod cover without departing from the scope of my invention, it is intended that all matter contained in the foregoing description and shown in the accompanying drawing shall be interpreted as illustrative only.

I claim:

1. A cover adapted to be used with an existing and fully functional drapery rod assembly, wherein the drapery rod assembly comprises an elongated member adapted to support the drapery, at least a pair of brackets with one of the brackets being located at each end of the elongated member, means to connect each end of the elongated member to an end of the adjacent bracket and means at the opposite end of each bracket to secure the assembly to a wall structure, said cover comprising an elongated tubular member open along its entire length for a portion of its circumference, a pair of end pieces with each piece having a curved end corresponding in size and shape to the inner surface of said tubular member and means for detachably securing each end piece to one of the brackets of the drapery rod assembly, said securing means including an element adapated to engage an inner surface of said one bracket, means interconnecting said element to an adjacent end piece in order to clamp said adjacent end piece to the outer surface of the said one bracket, whereby each end piece may be fastened to an existing bracket with each said curved end projecting beyond the existing drapery rod assembly so that said tubular member may be fastened over said curved ends, thereby occupying a position in front of the drapery rod assembly and thus providing a cover therefore.

2. The cover of claim 1, including a supporting bracket having a curved end for engagement within said tubular member and a flat portion connected to one end of said curved end and adapted to be detachably secured to the upper surface of an interiorly located bracket of said existing drapery rod assembly and thus provides added support for said cover.

3. The cover of claim 1, including an elongated, C-shaped, curved connector member of a size and shape adapted to be snugly carried within said tubular member so that a pair of tubular members may each be placed over said curved connector in order to increase the length of said cover.

4. The cover of claim 1, including a plurality of C-shaped clamps of a size and shape to snugly fit within said tubular member, said clamps adapted to securely fasten cover material positioned over the outer surface of said tubular member.

5. The cover of claim 1, wherein said end piece is made of wood and said element of said securing means comprises a plurality of screws.

6. The cover of claim 1, including an ornamental end member provided with a C-shaped extension at one end, said extension being of a size and shape to be snugly carried within an end of said tubular member to thus provide an extension thereto.

7. The cover of claim 1, wherein said end piece has an open interior and said securing means comprises a spring clip and said element comprises a pair of flanges for fastening said clip to the existing bracket and said interconnecting means comprises a central portion of the clip which is adapted to securely fit within said open interior of said end piece.

8. The cover of claim 7, wherein said end piece is made of plastic material.

9. The cover of claim 7, wherein said end piece is metallic.

10. The cover of claim 7, including a retainer member of a size and shape corresponding to the interior of said end piece adapted to securely fasten a covering positioned over the outer surface of said end piece and having an open interior adapted to receive said spring clip.

11. The cover of claim 1, wherein said element includes a planar surface portion adapted to engage the inner surface of the said one bracket.

12. A cover for an existing drapery rod assembly comprising an elongated tubular member open along its entire length for a portion of its circumference, a pair of end pieces having a curved end corresponding in size and shape to the inner surface of said tubular member, means for detachably securing each end piece to an end bracket of said existing drapery rod assembly, whereby each end piece may be fastened to the outer surface of an existing bracket with its curved end projecting beyond the existing drapery rod assembly so that said tubular member may be fastened over said curved ends and thereby occupy a position in front of said drapery rod assembly and thus provides a covering therefore, wherein said elongated tubular member is of a length to extend beyond each end piece and is mitered at each end, a further pair of tubular members, means for securing said pair of tubular members to a wall, one end of said further pair of tubular members also being mitered so as to present a curved end when abutted with the mitered end of said elongated tubular member.

13. A cover for an existing drapery rod assembly comprising an elongated tubular member open along its entire length for a portion of its circumference, a further pair of tubular members open along their entire length for a portion of each of their circumferences, means for detachably securing each of said further pair of tubular members to an existing end bracket of said drapery rod assembly, means for detachably securing said elongated tubular member to the rod of said existing drapery rod assembly, one end of each pair of tubular members being mitered and each end of said elongated tubular member also being mitered so as to present a curved end when abutted with the mitered end of one of said pair of tubular members, whereby the tubular members are adapted to be positioned over the outer surface of said existing drapery rod assembly and detachably fastened thereto.

14. The cover of claim 13, including a plurality of C-shaped clamps of a size and shape to snugly fit within each of said tubular members, said clamps adapted to securely fasten cover material positioned over the outer surface of said tubular members.

15. The cover of claim 13, wherein said securing means for said pair of tubular members comprises a spring clip having a pair of flanges for fastening the clip to said existing end bracket and a curved central portion adapted to securely fit wihin said pair of tubular members.

* * * * *